US006561151B1

(12) United States Patent
Wisnia et al.

(10) Patent No.: US 6,561,151 B1
(45) Date of Patent: May 13, 2003

(54) REMOTE CONTROL CAR STARTER

(75) Inventors: Jack Wisnia, Dollard-des-Ormeaux (CA); Jean-Pierre Lavoie, Town of Mont Royal (CA)

(73) Assignee: 3061868 Canada Inc., Town of Mount Royal (CA)

( * ) Notice: Subject to any disclaimer, the term of this patent is extended or adjusted under 35 U.S.C. 154(b) by 0 days.

(21) Appl. No.: 09/642,565

(22) Filed: Aug. 22, 2000

(51) Int. Cl.[7] ..... F02N 11/08
(52) U.S. Cl. ..... 123/179.2; 123/179.3
(58) Field of Search ..... 123/179.2, 179.3

(56) References Cited

U.S. PATENT DOCUMENTS

| | | | | |
|---|---|---|---|---|
| 4,080,537 | A | | 3/1978 | Bucher |
| 4,198,945 | A | | 4/1980 | Eyermann et al. |
| 4,488,521 | A | | 12/1984 | Miller et al. |
| 4,674,454 | A | | 6/1987 | Phairr |
| 4,947,123 | A | | 8/1990 | Minezawa |
| 5,024,186 | A | | 6/1991 | Long et al. |
| 5,129,376 | A | | 7/1992 | Parmley |
| 5,349,931 | A | | 9/1994 | Gottlieb et al. |
| 5,612,578 | A | | 3/1997 | Drew |
| 5,656,868 | A | | 8/1997 | Gottlieb et al. |
| 5,673,017 | A | | 9/1997 | Dery et al. |
| 5,689,142 | A | | 11/1997 | Liu |
| 5,717,312 | A | | 2/1998 | Maeda et al. |
| 5,773,977 | A | | 6/1998 | Dougherty |
| 5,905,315 | A | | 5/1999 | Lefebvre et al. |
| 5,942,988 | A | | 8/1999 | Snyder et al. |
| 5,970,936 | A | * | 10/1999 | Cabrera et al. ..... 123/179.3 |
| 5,983,850 | A | * | 11/1999 | Vilou ..... 123/179.3 |

* cited by examiner

*Primary Examiner*—Willis R. Wolfe
*Assistant Examiner*—Arnold Castro
(74) *Attorney, Agent, or Firm*—James Angelhart; Ogilvy Renault

(57) ABSTRACT

A method for starting a car engine remotely by sensing the car battery voltage using an algorithm that can adjust its K value on a regular basis whenever the remote control is put into learn mode and a manual sequence is carried out prior to starting the car remotely. The device is highly reliable and easy to install due to a reduction in the amount of wires necessary for its installation and functioning. The device can be used for a wide variety of vehicles.

18 Claims, 6 Drawing Sheets

REMOTE CONTROL CAR STARTER

FIELD OF THE INVENTION

The invention relates to the field of remote motor vehicle starter systems, and more particularly, to the use of battery voltage monitoring to determine the appropriate cut-off voltage of a starter engine.

BACKGROUND OF THE INVENTION

Starting a car from a distance has its-appeal particularly in extreme weather. There are a variety of devices that can perform this type of operation. An important function of a remote car starter is determining when to stop cranking the starter engine. In a manual starting operation, this corresponds to the release of the key in the ignition from the START position to the ON position. A person performing this action manually can either sense the engine has started from the vibrations of the vehicle or hear the change in sound being emitted from the vehicle.

However, when starting a vehicle from a distance, neither of the two characteristics one relies on to start a car manually can be depended upon. Controlling the cut-off of the starter engine must be done some other way. The timing involved in this particular task is critical to the functionality of the remote control car starter and any slight deviation from the optimal time can have negative effects on the starter as well as the engine of the vehicle.

However, there are certain key features that are important in order for a remote control car starter to be sufficiently practical and properly respond to the needs of the current market. These features are crucial to the optimization of a remote control car starter. The first one is that the remote control starter be simple to install. It is of high importance that the device be simple to install because the installation is often done by the average technician or mechanic and an installation process of high complexity could lead to many problems. The goal is to have the lowest probability of error in the installation process so as to minimize the risk of affecting any other component in the vehicle.

Another key feature is the reliability of the device. The objective of highest possible reliability is hard to achieve when there are many wires that can be affected by such things as corrosion or a short circuit with another wire present under the hood of a car. The third and equally important feature of a remote car starter is that it be universal, i.e. it can work on as many different car models as possible. A starter that is limited to certain models is of little use on the market.

Simplicity, reliability, and adaptability are the issues that must be improved upon in order to properly comply to the needs of the market. It would be ideal to combine these features with a remote control car starter that uses battery voltage sensing techniques to determine start and release times of the starter motor. This particular method reduces the amount of wires present for the remote car starter and simplifies the installation process.

As stated in the Background of the Invention of U.S. Pat. No. 5,905,315 to Lefebvre et al., there are already proposed methods to control the cut-off of the starter engine of a vehicle by monitoring the battery voltage. The proposed method of the aforementioned Patent utilizes a method of voltage sensing of a battery voltage in which the starter is cut-off when the battery voltage reaches a threshold value, this threshold value being a function of the initial battery voltage and a fixed constant K. The constant value K is set to be less than or equal to 1. The initial battery voltage is measured before the starter is activated and a fraction of this value (corresponding to a product of K and the initial voltage) is compared to the battery voltage during the ignition process. The starter is cut-off when the sensed battery voltage reaches a threshold value. This way, when there is a change in the initial battery voltage, there is a corresponding change in the cut-off voltage.

Lefebvre does not disclose how K is calibrated. This makes it difficult to adjust the K value to each car. Since it is unlikely that every vehicle will have the same K value, a fixed K value may work better on some vehicles than others and does not render the device universal.

SUMMARY OF THE INVENTION

Accordingly, an object of the present invention is to provide a remote control car starter system with a simplified installation process. Self-programming of the system removes the need to set the starting parameters to any pre-determined value necessary for the starting process. This simplification will reduce the risk of error in the installation process.

Another object of the present invention is to provide a remote control car starter that is reliable in the long run. It is the object of this invention to reduce the number of wires used to connect the device to the other components in the vehicle. This will decrease the risk of a malfunction of the device due to a wire being broken or shorted with another wire and will also contribute to making the installation of the device easier.

Yet another object of the present invention is to provide a remote control car starter that can learn from one or a series of manual starts what should be an appropriate K value. This way, it can adapt itself to a wide variety of different models of vehicles.

In accordance with a first aspect of the present invention, there is provided a method for starting an engine automatically comprising the steps of measuring the battery voltage of a battery powering the starter motor of an engine over time to obtain a measured battery voltage; detecting a manual start of the starter motor; detecting a manual release of the starter motor; calculating a ratio K of the measured battery voltage prior to the manual start to the measured battery voltage at or before the manual release; and during automatic starts, monitoring the battery voltage, starting the starter motor and releasing the starter motor when the battery voltage reaches a value equal to the product of K and the battery voltage sampled prior to starting the starter motor automatically.

In accordance with a second aspect of the present invention, a device is provided for starting an engine automatically comprising a voltage measurer for measuring the battery voltage of a battery powering the starter motor of the engine to obtain a measured voltage; a learn controller for detecting a manual start and a manual release of the starter motor and calculating a ratio K of the measured voltage prior to the manual start to the measured voltage at or before the manual release; a storage device to store the ratio K; a remote start controller for starting the starter engine remotely and releasing the starter engine when the battery voltage reaches a value equal to a product of K and the battery voltage sampled prior to starting the starter motor automatically; and a Transmitter/Receiver (TX/RX) module to transmit and receive signals.

BRIEF DESCRIPTION OF THE DRAWINGS

These and other features, aspects and advantages of the present invention will become better understood with regard to the following description and accompanying drawings wherein.

DETAILED DESCRIPTION OF THE PREFERRED EMBODIMENT

Figure 1:
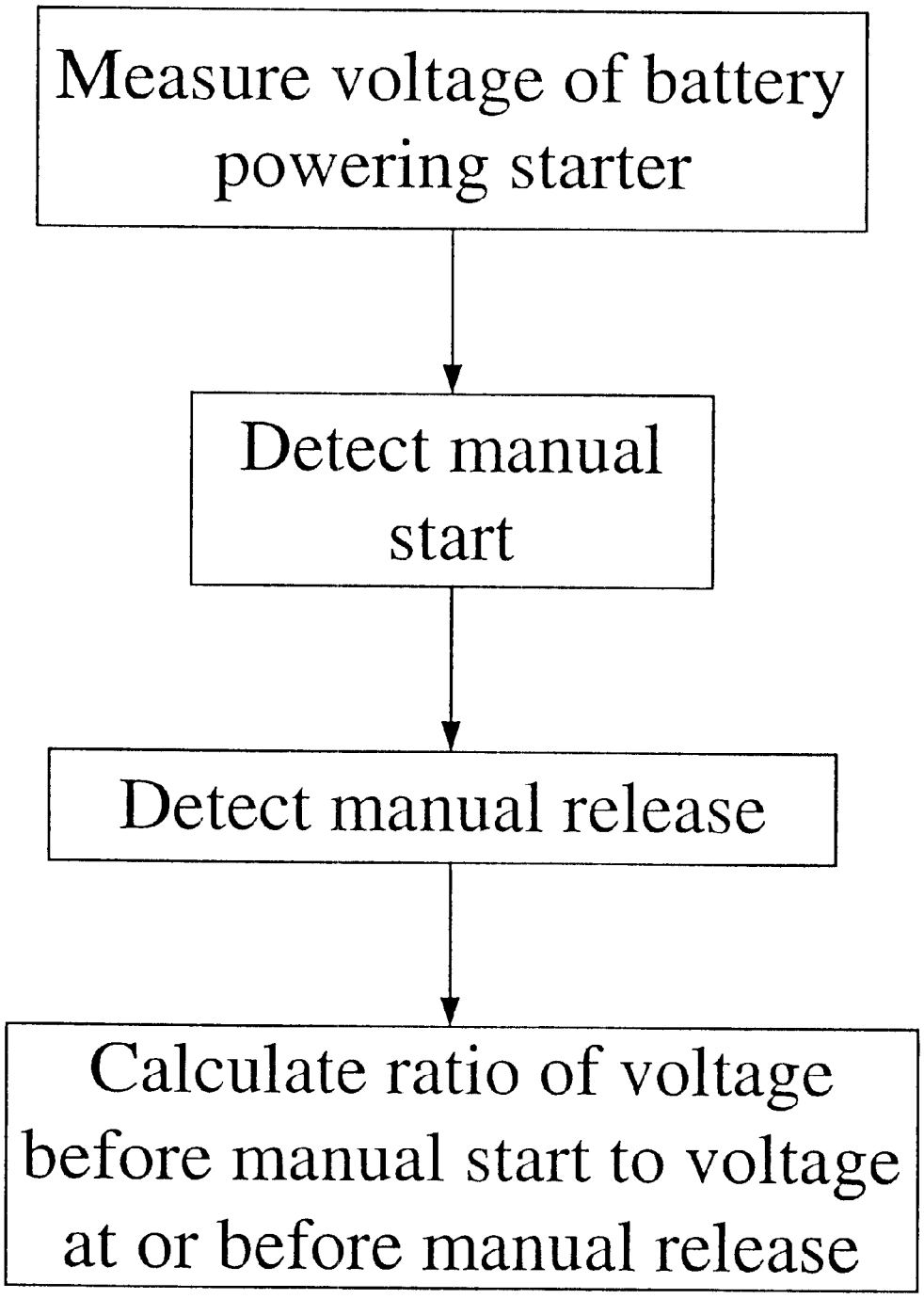
FIG. 1 is a flow chart of the learning process.

K, the ratio of the battery voltage before a manual start to the battery voltage at or before a manual release, is calculated while the remote control starter is in learn mode. In the preferred embodiment, learn mode can be selected either with a switch on the remote control, or through software that is programmed to enter learn mode at fixed intervals of time. When learn mode is entered, a learning procedure consisting of a manual sequence carried out prior to starting the car remotely using the remote control car starter is done. FIG. 1 outlines the steps necessary for the learning procedure. An initial voltage measurement is taken on the battery that powers the starter. This step can further comprise the step of acquiring voltage samples using an A/D converter and storing the voltage data samples for $T_{delta}$ seconds from the current time in a buffer, wherein $T_{delta}$ is approximately 200 ms and corresponds to the average operator response time. Acquiring the voltage samples in this way can further comprise of a step of averaging and filtering the samples using appropriate means. A manual start is detected and a second voltage measurement is taken when a manual release is detected. The ratio K is then calculated.

It is implied that the learning procedure is done in ambient or warm temperature and not in an excessively cold environment. Performing the procedure in an excessively cold environment would translate into a longer starter activation of the starter motor, biasing the minimum starter activation time to a higher value than required for normal and warmer conditions and therefore, causing the battery voltage to be lower than normal upon manual release and altering the value of K. Optionally, a temperature sensor can be present in the device. The temperature sensor would be capable of determining if the engine is of appropriate temperature to enter the learn mode and calculate K. This would avoid setting an inappropriate K value for the device.

Figure 2:
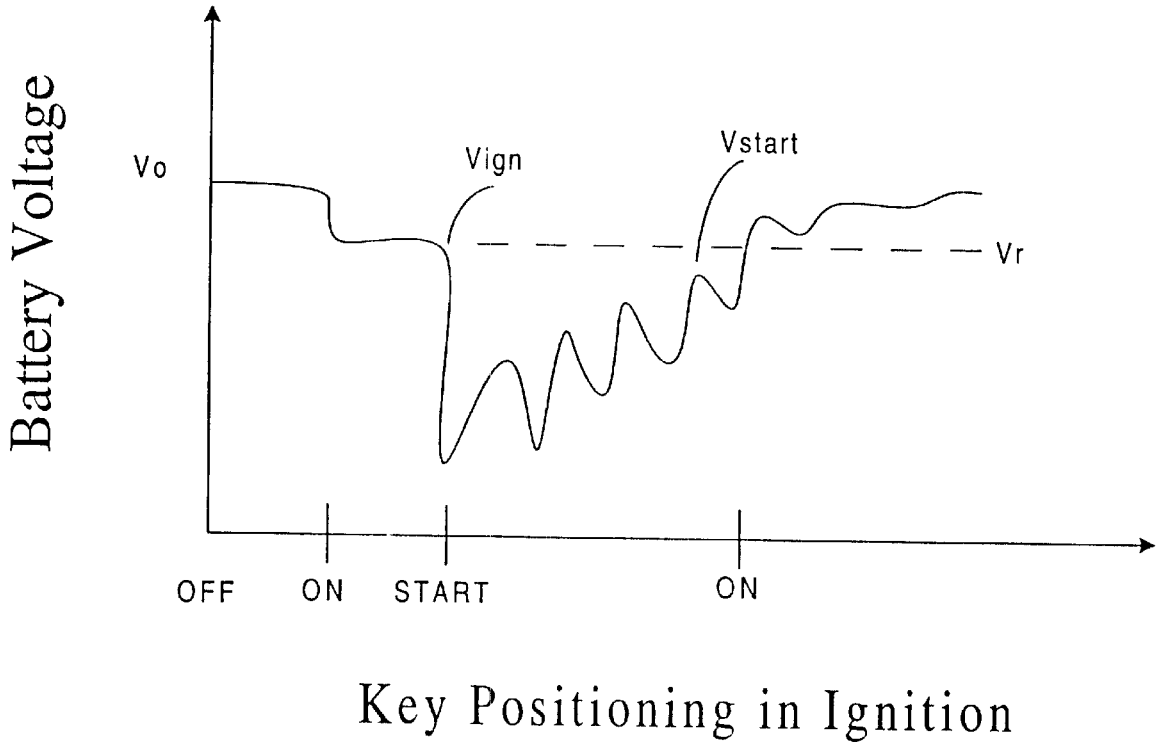
FIG. 2 illustrates a curve of battery voltage vs. key positioning in the ignition during the process of starting a car engine.
Figure 3A:
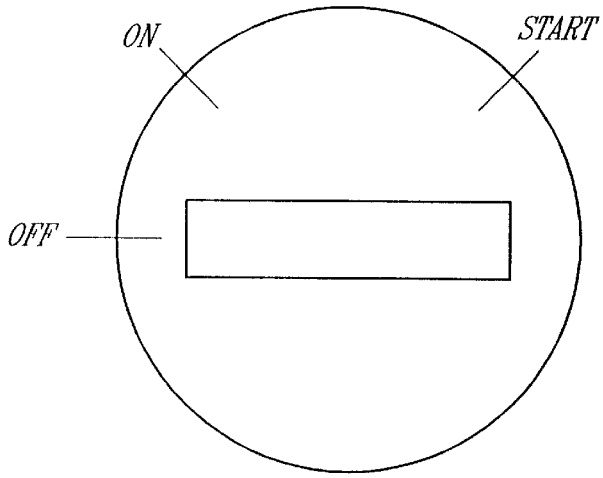
FIG. 3A is a schematic of the ignition key in the OFF position.
Figure 3B:
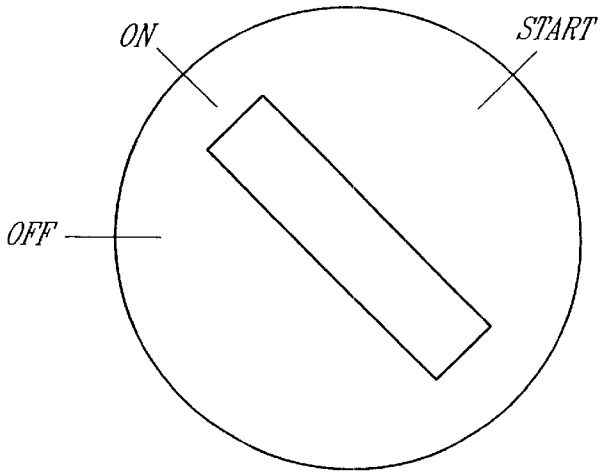
FIG. 3B is a schematic of the ignition key in the ON position.
Figure 3C:
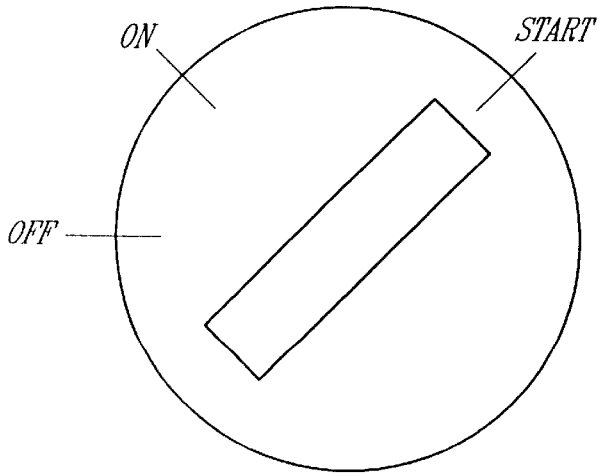
FIG. 3C is a schematic of the ignition key in the START position.

FIG. 2 is a graph of the battery voltage response throughout the start-up process of a vehicle engine. The pattern of the battery voltage level remains the same whether the vehicle is started manually or remotely but the parameters indicated on the graph illustrate a manual start. $V_o$ is the initial voltage of the engine battery while the engine is off. This corresponds to the OFF position of the ignition slot in FIG. 3A. When the ignition key is rotated clockwise to ON, as in FIG. 3B, the voltage of the battery goes down slightly to $V_{ign}$. At this point, all of the accessories of the vehicle are functional but the engine is not yet started. As the starter is cranked, as in FIG. 3C, the battery voltage goes down extremely low and oscillates irregularly as it slowly goes back up. $V_{start}$ is the point when the engine is actually started. $V_r$ is when the key is released by the user and returned to the ON position, as in FIG. 3B. $V_{start}$ occurs approximately $T_{delta}$, the sum of the human reaction time and deactivation time of the starter motor, before the key is released. Using $V_{ign}$ and $V_{start}$, a constant threshold value K can be calculated to allow the starter to be released when it reaches a fraction K of the battery voltage prior to the starter being cranked. The equation:

$$K = \left(\frac{V_{start}}{V_{ign}} * 100\right) - 3$$

is used to calculate a value for K.

Figure 4:
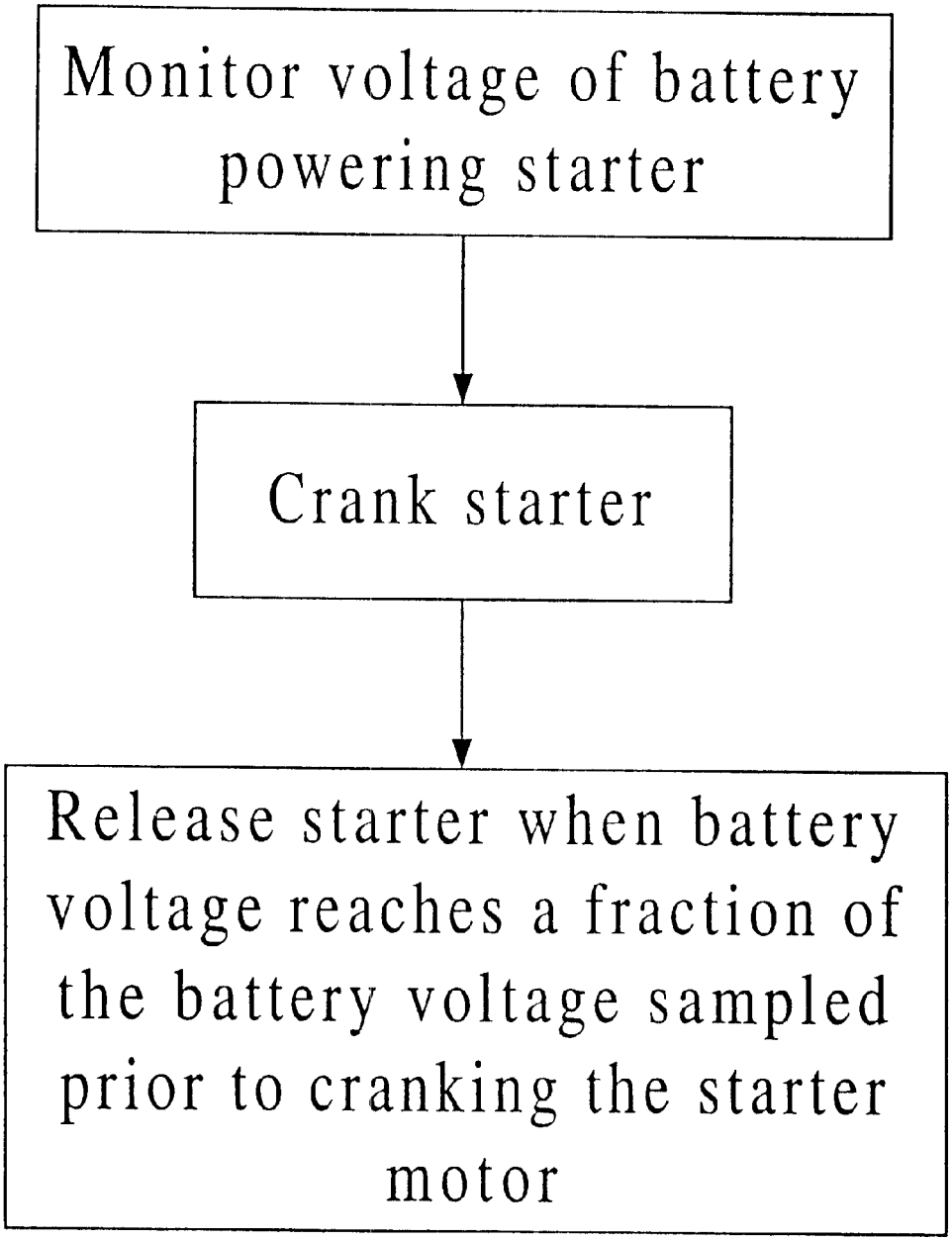
FIG. 4 is a flow chart of the automatic start process.

FIG. 4 is a flow chart of the steps for the automatic start procedure. This is done only after a value K has been calculated through a learning procedure. The battery voltage is monitored throughout the entire process. The starter engine is cranked and then released when the battery voltage reaches a value equal to a product of K and the battery voltage sampled prior to cranking the starter motor.

Figure 5:
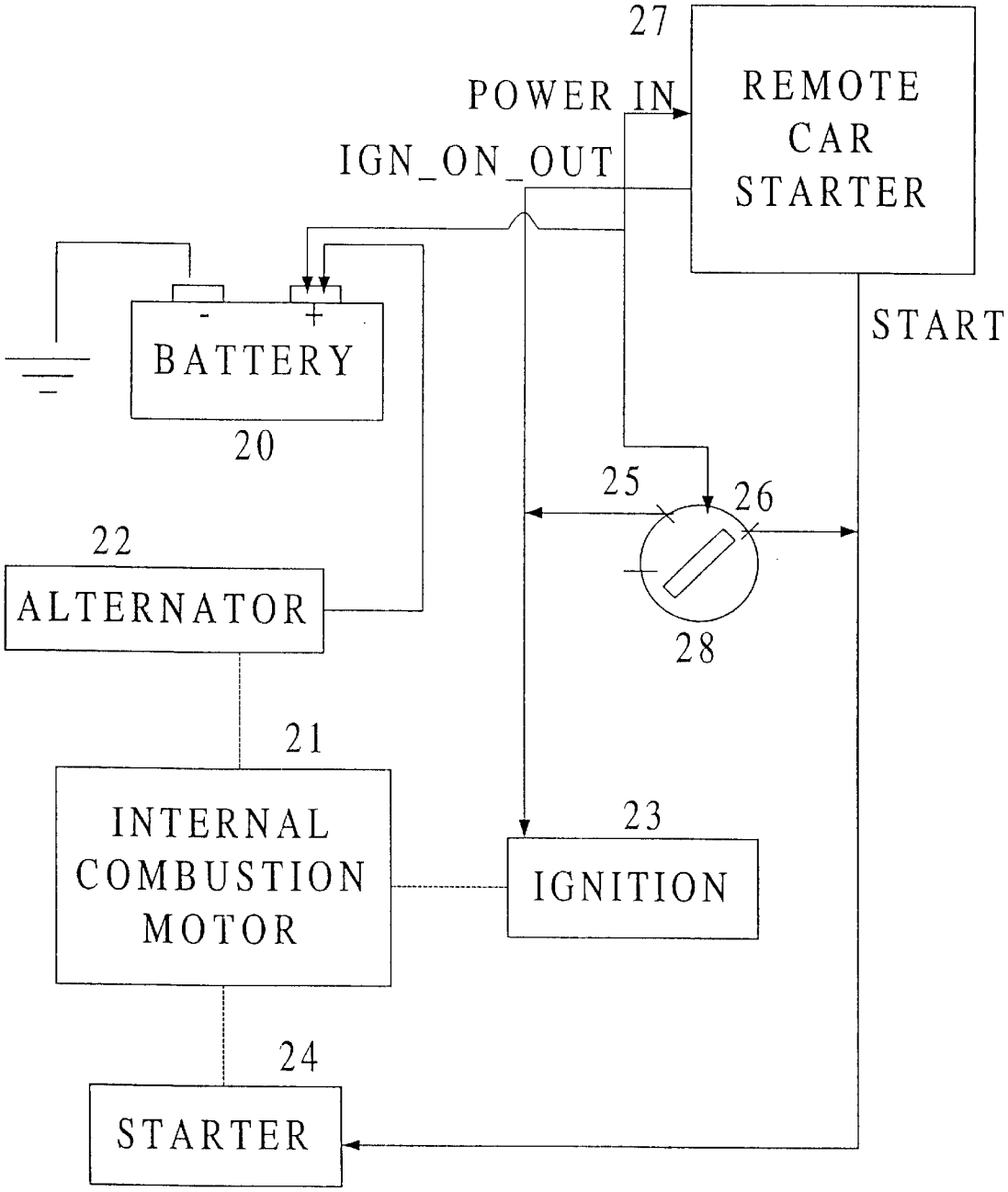
FIG. 5 is a block diagram of the connection of the remote car starter with the inside of a motor vehicle.

FIG. 5 is a block diagram of the interconnections necessary inside a vehicle for the preferred embodiment of the remote control car starter. Within the internal combustion motor 21 reside the alternator 22, the ignition 23, and the starter 24. All three of these components are necessary to start a vehicle. The alternator's 22 function is to produce the current necessary for the electrical needs of the car and keep the battery charged. The battery 20 supplies power to the remote car starter 27 by sending in a POWER IN signal. Through the ignition switch 28, the battery 20 can be connected to the ignition 23 and the starter 24. Putting the ignition switch 28 to the ON position 25 connects the ignition to the battery 20, whereas putting the ignition switch 28 to the START position 26 connects the ignition 23 and the starter 24 to the battery 20.

Figure 6:
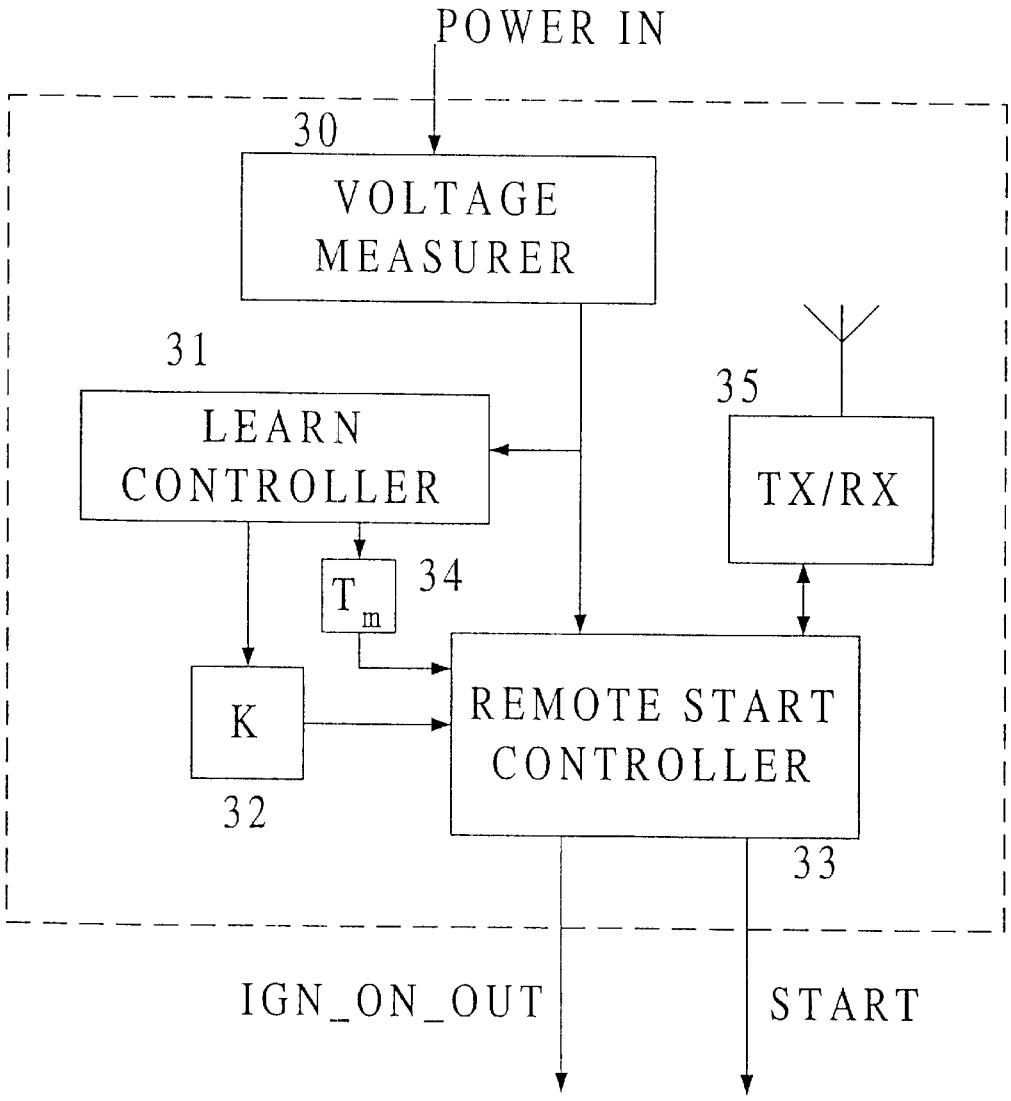
FIG. 6 is a block diagram of the inside of the remote car starter.

During an automatic start, the remote car starter 27 sends an IGN_ON_OUT signal to the ignition 23. To crank the starter motor, a START signal is sent from the remote car starter 27 to the starter 24. These two signals are controlled by the remote start controller 33, seen in FIG. 6. FIG. 6 is the inside view of the remote car starter 27 component of FIG. 5. A voltage measurer 30 monitors the battery 20 voltage using the POWER IN signal. The IGN_ON_OUT signal is sent to the ignition 23 to ignite or light a fuel charge by means of a spark in the engine. The START signal is then sent to the starter 24 to crank the engine for starting. When the voltage measurer 30 determines that the battery voltage has reached a value equal to a product of K and the battery voltage sampled prior to starting the starter motor automatically, the remote start controller 33 releases the starter motor. The communications between the remote car starter 27 present under the hood of the vehicle and the remote control is done through the transmitter/receiver 35.

The learn controller 31 module receives a signal from the voltage measurer 30 in order to calculate a K value during the learning process. From this signal, the learn controller 31 can detect a manual start and a manual release of the starter motor. In the preferred embodiment, the learn controller 31 calculates an initial value for K, stores it in memory 32, and it remains set. Alternatively, the learn controller can calculate a value for K that can be updated on a regular basis. The update can be done regularly by just entering a learn mode and recalculating a K value or the learn controller 31 can be set to take the average of a plurality of most recent manual starts to calculate the K value on a regular basis. However, a manual start done on a warm engine must not be considered in the average. Therefore, the learn controller 31 can be set to disregard any manual start that occurs less than a minimum time period of 20 minutes following an engine shutdown.

Another alternative is to have a temperature sensor within the device that can sense outside temperature (not shown). A plurality of K values can be stored in memory 32, each value corresponding to a specific range of outside temperatures. The remote start controller 33 would then select the appropriate K value depending on the outside temperature.

$T_m$ is the ideal activation time of a starter motor, more particularly, the minimum time delay activation of a starter motor. Just after energizing the starter motor, the voltage pattern presents a steep drop since a high initial inrush current is drained by the starter solenoid. The voltage analysis is not performed before the completion of $T_m$ since there is no useful information regarding whether the engine actually started that can be used during that time delay.

$T_{crank}-T_m+T_{release}$ where $T_{release}$ is the variable time delay required to get the engine running on fuel under varying conditions such as vehicle engine characteristics, battery condition, and temperature.

$T_m$ is defined as the total starter motor activation time minus $T_{delta}$ and should stay within the range 475 ms to 3 s. Preferably, $T_m$ is determined from a warm start during a learn mode. It is preferred that once the automatic start of the engine has begun, the starter be cranked for a maximum time Tmax (5 seconds) and released once this value is exceeded regardless of whether the engine has started or not.

A start command signal for the remote car starter 27 can be received from a remote control. A transceiver 35 is connected to the remote start controller 33 to receive and send high frequency signals.

It will be understood that numerous modifications thereto will appear to those skilled in the art. Accordingly, the above description and accompanying drawings should be taken as illustrative of the invention and not in a limiting sense.

It will further be understood that it is intended to cover any variations, uses, or adaptations of the invention following, in general, the principles of the invention and including such departures form the present disclosure as come within known or customary practice within the art to which the invention pertains and as may be applied to the essential features hereinbefore set forth, and as follows in the scope of the appended claims.

What is claimed:

1. A method for starting an engine automatically comprising the steps of:

measuring a battery voltage of a battery powering a starter motor of said engine over time to obtain a measured battery voltage;

detecting a manual start of said starter motor;

detecting a manual release of said starter motor;

calculating a ratio K of said measured battery voltage prior to said manual start to said measured battery voltage at or before said manual release;

during automatic start, monitoring said battery voltage, starting said starter motor and releasing said starter motor when said battery voltage reaches a value equal to a product of K and said battery voltage sampled prior to starting said starter motor automatically.

2. A method as defined in claim 1, wherein a start command signal is received from a remote control.

3. A method as defined in claim 1, wherein the step of measuring a voltage of a battery powering a starter motor further comprises the step of acquiring voltage samples using an A/D converter and storing the voltage data samples for an average operator response time $T_{delta}$ seconds from the current time in a buffer.

4. A method as defined in claim 2, wherein the step of acquiring voltage samples further comprises averaging and filtering said samples.

5. A method as defined in claim 3, wherein the step of performing the calculation of K further comprises deriving the value from said measured voltage prior to said manual start, $V_{ign}$, and said measured voltage at or before said manual release, $V_{start}$, obtained $T_{delta}$ seconds before the end of the starter motor activation, using the equation:

$$K = \left(\frac{V_{start}}{V_{ign}} * 100\right) - 3$$

where 3 is the tolerance factor, within a minimum K value of 60 and a maximum K value of 97.

6. A method as defined in claim 3, wherein during said automatic start, said engine is cranked for a minimum time $T_m$.

7. A device for starting an engine automatically comprising;

a voltage measurer for measuring a battery voltage of a battery powering a starter motor of said engine to obtain a measured voltage;

a learn controller for detecting a manual start and a manual release of said starter motor and calculating a ratio K of said measured voltage prior to said manual start to said measured voltage at or before said manual release;

a storage device to store said ratio K; and a remote start controller for starting said starter motor and releasing said starter motor when said battery voltage reaches a value equal to a product of K and said battery voltage sampled prior to starting said starter motor automatically.

8. A device as defined in claim 7, further comprising an A/D converter to acquire voltage samples and a buffer for storing said voltage samples.

9. A device as defined in claim 8, further comprising means for averaging and filtering said voltage samples.

10. A device as defined in claim 7, wherein said learn controller calculates a value for K and it remains set.

11. A device as defined in claim 7, wherein said learn controller calculates a value for K that can be updated on a regular basis.

12. A device as defined in claim 11, wherein said learn controller is set to take the average of a plurality of most recent manual starts to calculate said K value.

13. A device as defined in claim 12, wherein said learn controller is set to disregard a manual start that occurs less than a minimum time period of 20 minutes following an engine shutdown in order to calculate K.

14. A device as defined in claim 7, further comprising a temperature sensor, and a plurality of K values stored in said storage device, each K value corresponding to a range of temperatures, said temperature sensor sensing the outside temperature and said remote start controller using the K value appropriate for said outside temperature.

15. A device as defined in claim 7, wherein said remote car starter responds to a start command signal, said start signal is received through a transceiver.

16. A device as defined in claim 7, wherein said learn controller calculates a minimum starter motor activation time $T_m$, defined as the total starter motor activation time minus an average operator response time $T_{delta}$ seconds, within a minimum value of 475 ms and a maximum value of 3 seconds, said remote start controller automatically cutting off said starter motor after $T_m$ seconds, regardless of whether said engine has started or not.

17. A device as defined in claim 7, wherein $T_{delta}$ is approximately 200 ms and corresponds to the average operator response time.

18. A device as defined in claim 7, further comprising a temperature sensor, said temperature sensor capable of determining if the engine is of appropriate temperature to enter a learn mode and calculate K, whereby K is not calculated if the engine is warm.

* * * * *